US006652239B2

(12) United States Patent
Carstensen

(10) Patent No.: US 6,652,239 B2
(45) Date of Patent: Nov. 25, 2003

(54) MOTOR CONTROLLER FOR A HYDRAULIC PUMP WITH ELECTRICAL REGENERATION

(75) Inventor: Peter T. Carstensen, Adirondack, NY (US)

(73) Assignee: Kadant Inc., Acton, MA (US)

( * ) Notice: Subject to any disclaimer, the term of this patent is extended or adjusted under 35 U.S.C. 154(b) by 0 days.

(21) Appl. No.: 10/230,469

(22) Filed: Aug. 29, 2002

(65) Prior Publication Data

US 2002/0197166 A1 Dec. 26, 2002

Related U.S. Application Data

(63) Continuation-in-part of application No. 09/821,603, filed on Mar. 29, 2001, now Pat. No. 6,494,685.

(51) Int. Cl.[7] ..... F04B 49/06; F04B 49/10; F16D 31/02

(52) U.S. Cl. ..... 417/44.11; 417/53; 417/9; 417/45; 60/414

(58) Field of Search ..... 417/53, 9, 43, 417/44.11, 45; 60/414, 431

(56) References Cited

U.S. PATENT DOCUMENTS 4,604,036 A * 8/1986 Sutou et al. ..... 417/18
4,726,738 A 2/1988 Nakamura et al.
5,064,347 A * 11/1991 LaValley, Sr. ..... 417/9
5,318,409 A * 6/1994 London et al. ..... 417/53
5,647,208 A * 7/1997 Spitzbarth ..... 60/371
5,658,133 A * 8/1997 Anderson et al. ..... 417/63
5,827,051 A * 10/1998 Smith ..... 417/375
6,005,360 A * 12/1999 Pace ..... 318/376

FOREIGN PATENT DOCUMENTS

EP 0 302 493 A2 2/1989

* cited by examiner

*Primary Examiner*—Cheryl J. Tyler
*Assistant Examiner*—Timothy P. Solak
(74) *Attorney, Agent, or Firm*—Frommer Lawrence & Haug LLP; Ronald R. Santucci

(57) ABSTRACT

Disclosure is made of a precision hydraulic energy delivery system that directly couples the pump to a primary mover (motor) and a related motor control. The system provides flow control of a hydraulically driven machine without the use of downstream devices by employing motion control algorithms in the motor control. Control features are electronically integrated into the hydraulic system by using control algorithms and subroutines specifically developed for the prime mover servo control system coupled to the pump.

9 Claims, 7 Drawing Sheets

FIG. 4

| "Q" | %torque above mean | % torque below mean | Total variation % |
|---|---|---|---|
| 4:1 | 8.2 | 20.0 | 28.2 |
| 5:1 | 7.6 | 17.6 | 25.2 |
| 6:1 | 6.9 | 16:1 | 23.0 |
| 7:1 | 6.4 | 15.2 | 21.6 |

MOTOR CONTROLLER FOR A HYDRAULIC PUMP WITH ELECTRICAL REGENERATION

RELATED APPLICATIONS

This application is a continuation-in-part of U.S. patent application Ser. No. 09/821,603, filed Mar. 29, 2001, Now U.S. Pat. No. 6,494,685, the disclosure of which is hereby incorporated by reference.

BACKGROUND OF THE INVENTION

1. Field of the Invention

This invention relates to a method of electronically attenuating the torque command based on a polar grid modeled on the torque profile of a positive displacement pump in order to produce a constant pump pressure regardless of pump radial crankshaft/camshaft/crankarm location and the velocity of the fluid being pumped. In the method, an electronic processor compares the shaft displacement angle of the pump input shaft to a reference polar grid of the torque profile and varies the electrical power applied to the pump motor. The processor can also take into account the response time of the pump drive, the motor inductive reactance, system inertia, application characteristics of the pump, and regenerative energy during deceleration of the pump.

This invention also relates to a precision hydraulic energy delivery system. Direct coupling of the pump to a primary mover (motor) and related motor control allows for complete motion control of a hydraulically driven machine without the use of any downstream devices. By employing motion control algorithms in the motor control, the hydraulic output at the pump head is controlled in a feed forward method.

2. Description of the Prior Art

In the prior art, it is well known that in situations where higher pressures of fluid movement are desired, a positive displacement pump is commonly used. A positive displacement pump is usually a variation of a reciprocating piston and a cylinder, of which the flow is controlled by some sort of valving. Reciprocal machinery, however can be less attractive to use than rotary machinery because the output of a reciprocal machine is cyclic, where the cylinder alternatively pumps or fills, therefore there are breaks in the output. This disadvantage can be overcome to a certain extent by: using multiple cylinders; bypassing the pump output through flow accumulators, attenuators, dampers; or waste gating the excess pressure thereby removing the high pressure output of the flow.

In addition to uneven pressure and flow output, reciprocating pumps have the disadvantage of uneven power input proportional to their output. This causes excessive wear and tear on the apparatus, and is inefficient because the pump drive must be sized for the high torque required when the position of the pump connecting rod or cam, in the case of an axial (wobble plate) pump, is at an angular displacement versus the crankarm dimension during the compression stroke that would result in the highest required input shaft torque.

Moreover, if the demand of the application varies, complicated bypass, recirculation, or waste gate systems must be used to keep the system from "dead-heading". That is, if flow output is blocked when the pump is in operation, the pump will either breakdown by the increased pressure or stall. If stalling occurs, a conventional induction electric motor will burn out as it assimilates a locked rotor condition with full rated voltage and amperage applied. Typically systems with fixed displacement pumps use a relief valve to control the maximum system pressure when under load. Therefore, the pump delivers full flow at full pressure regardless of the application thus wasting a large amount of power.

In this regard, certain prior art that attempts to correct the problems associated with torque output of a pump motor should be noted.

In U.S. Pat. No. 5,971,721, an eccentric transmission transmits a torque demand from a reciprocating pump, which varies with time, to the drive motor such that the torque demand on the drive motor is substantially constant. The result is the leveling of torque variation required to drive a positive displacement pump at the transmission input shaft with the effect of constant pump output pressure. This is accomplished by means of eccentric pitch circle sprocket sets with gear belts or eccentric pitch circle matched gear sets.

The use of an eccentric gear or sprocket set, has a significant effect on the overall torque requirement and the magnitude of the discharge pulse of the pump. But, because most pumps are of a multi-cylinder or are vane or gear types, the pump input shaft torque requirement would not be perfectly counter-acted (leveled) by using the reduction pattern developed by eccentrically matched transmission components.

In U.S. Pat. No. 5,947,693, a position sensor outputs a signal by sensing the position of a piston in a linear compressor. A controller receives the position signal and sends a control signal to control directional motion output from a linear motor.

In U.S. Pat. No. 4,726,738, eighteen or nineteen torque leads are measured along the main shaft in order to maintain constant shaft velocity revolution and are translated to a required motor torque for particular angles of the main shaft.

U.S. Pat. No. 4,971,522 uses a cyclic lead transducer input and tachometer signal input to a controller to signal varied cyclic motor input controls to provide the required motor torque output. A flywheel is coupled to the motor in order to maintain shaft velocity. However, the speed of the motor is widely varied and the torque is varied to a smaller extent.

U.S. Pat. No. 5,141,402 discloses an electrical current and frequency applied to the motor which are varied according to fluid pressure and flow signals from the pump.

U.S. Pat. No. 5,295,737 discloses a motor output which is varied by a current regulator according to a predetermined cyclic pressure output requirement. The motor speed is set to be proportional to the volume consumed and inversely proportional to the pressure.

It is seen from the foregoing that there is a need for electronic attenuation of the torque profile in a pump. When the torque profile is compared with the input shaft displacement and other known factors such as system inertia and response time of the pump drive etc . . . , a pump can produce constant pressure and therefore constant flow without the typically associated ripple common to power pumps for the full range of the designed volumetric delivery, by driving them in a feed forward method.

It should be noted that the foregoing hydraulic pumping systems control output pressure and flow in the micro sense. These concepts examine modulating the input shaft torque and speed to provide a constant hydraulic output, whether it be pressure or flow limited. See U.S. Pat. No. 5,971,721 and U.S. patent application Ser. No. 09/821,603, the contents of which are hereby incorporated by reference.

It should be further noted that attempts to provide a high dynamic range of hydraulic flow and pressure during operation of prior pumping systems, required placement of downstream devices in the liquid path to modulate the hydraulic output. With such systems, the pump provides the maximum hydraulic flow (as the prime mover) and the downstream devices adjust the output to match the application requirements.

The prime mover in such systems is typically a constant speed induction motor. In to order to control the hydraulic output, feedback devices, a processor (be it mechanically balanced or electronic) and hydraulic servo valves must be placed into the hydraulic stream for flow and pressure regulation. This treatment of hydraulic delivery places the "smarts" of the system in the hydraulic output portion of the system. Disadvantageously, these systems require many hydraulically driven devices, are mechanically (geometry) limited, are energy inefficient when total system performance is scrutinized and have a small range of dynamic response (typically 10-1).

Moving the "smarts" directly into the prime mover—by incorporating variable speed (VFC) controlled motors—has been attempted. However, this provides limited torque delivery potential at low speeds, and many feedback devices are required for its operation. Further, the response of such a system is only generally higher than the 150 ms range and the energy savings potential is only in the 50% range.

These approaches address—in the macro sense—the need for a prime mover coupled to a power pump that controls the energy, and therefore the flow (velocity) and pressure (torque) at the input shaft of the pump. Moreover, the desired system must replicate the motion control capabilities of existing systems without requiring the use of downstream flow control devices and feedback circuits.

SUMMARY OF THE INVENTION

It is therefore an object of the present invention to provide a method for electronic attenuation of pump torque variation requirements in order to produce a matched motor torque output that will result in constant output pressure from a pump.

It is therefore a further object of the present invention to provide control factors which vary the power and torque output of a pump motor based on calculated torque variation requirements.

It is therefore a still further object of the present invention to increase the energy efficiency of a pump system, by providing a force balanced relationship between the motor output and the application's hydraulic requirement, thus allowing the use of energy saving torque drives without incurring the pressure variations associated with their use.

It is therefore a still further object of the present invention to decrease the wear and tear on the pump by providing a substantially constant force output from the motor of the pump and reduce the amount of cycles of the pump to the application's requirement.

It is therefore a further object of the present invention to provide a method for electronic attenuation of pump torque variation by supplying information for design of an electronic transmission system that can achieve a modulated torque output from the motor to the pump.

To attain the objects described, there is provided a method for obtaining a polar map for process control within the electronic drive of a targeted pump. This polar map is calculated by a processor or is externally calculated then input into a processor. Once the torque profile of the pump is obtained and translated into a polar map, the processor can compare the shaft displacement angle of the pump input shaft to the reference polar map. The processor can also take into account selected factors such as the response time of the pump drive, the motor inductive reactance, system inertia, application characteristics of the pump, and regenerative energy during deceleration of the pump.

Using selected factors and the comparison results, the processor then signals the motor controller to vary the amperage, voltage, and frequency applied to the motor in order to regulate the torque output of the pump motor. With an accurately modulated motor torque output in concert with the established polar map (for the targeted pump), the pump output pressure will remain constant regardless of the pump's crank arm location or the velocity of fluid flow.

It is also an object of the present invention to provide a hydraulic energy delivery system that allows for complete motion control of a hydraulically driven machine with the use of minimal or no downstream feedback devices.

It is therefore a further object of the present invention to provide control factors which vary the power and torque output of a pump motor by employing motion control algorithms.

To attain the objects described, there is provided direct coupling of a positive displacement pump to a pump drive motor and related controls. By employing motion control algorithms into the motor control, the hydraulic output at the pump head will simultaneously follow. Control features listed herein may be integrated into the system by developing algorithms and subroutines for the control system coupled to the pump.

The present invention will now be described in more complete detail with reference being made to the figures identified below.

BRIEF DESCRIPTION OF THE DRAWINGS

Thus by the present invention, its objects and advantages will be realized, the description of which should be taken with regard to the accompanying drawings herein.

FIG. 4 is a table depicting variations of input torque above and below the mean for triplex pumps in relation to the linear distance between the plunger/piston pivot point and the throw pivot point multiplied by the throw radius.

DETAILED DESCRIPTION OF THE PREFERRED EMBODIMENTS

Figure 1:
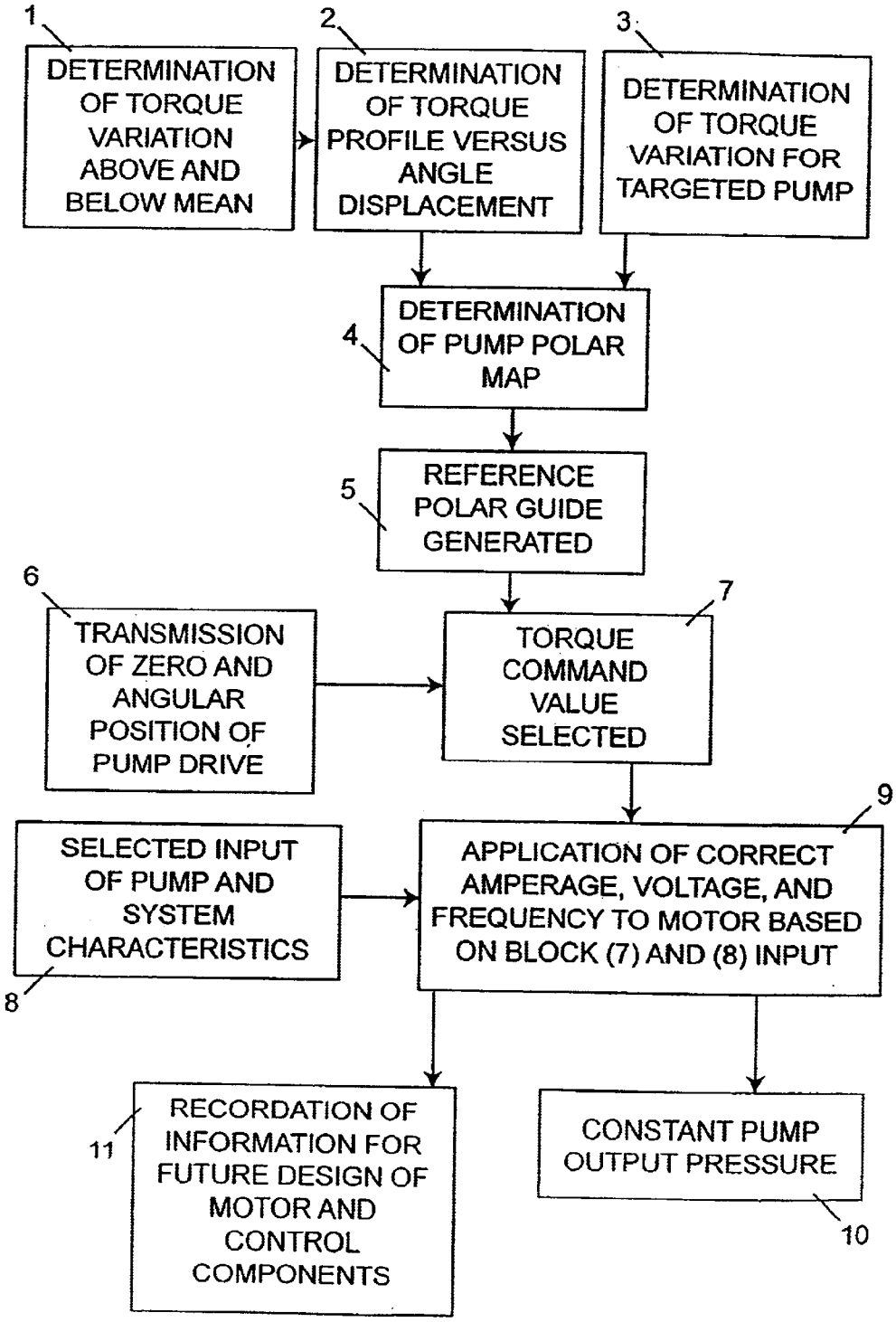
FIG. 1 is a block diagram of the steps required for a method of electronic attenuation of torque profile and the resulting control of the pump.

Referring now to the drawings in detail wherein like numerals refer to like elements throughout the several views where Blocks 1–5 of FIG. 1 depict the development of a baseline polar guide of the torque profile for the targeted pump.

Figure 2:
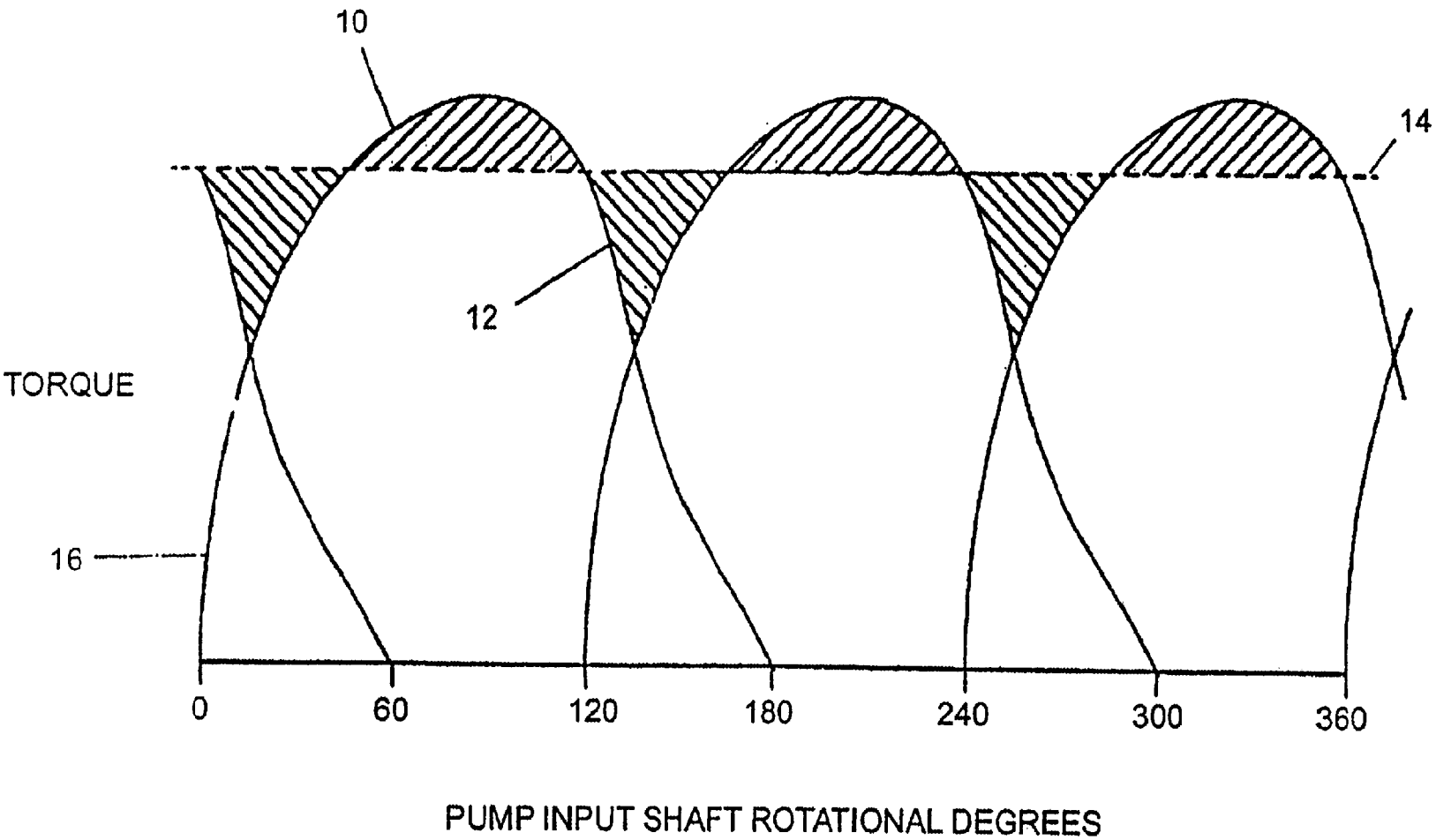
FIG. 2 is a graph depicting input torque variation for a triplex pump based upon pump input shaft rotational degrees.

In Block 1 of FIG. 1 and graphically depicted in FIG. 2, the output characteristic of volumetric displacement would directly relate to the input torque variations above 10 and below 12 the comparative mean 14. The processor identifies the output discharge characteristics such as the number of plungers, pistons in a piston pump, or vane/gear in a rotary pump. The processor also utilizes a comparative mean where, the comparative mean is representative of the basic torque requirement of the pump input shaft rated at a specific output pressure of the pump. A pulsation pattern 16 would be repeated at the same rate per revolution as the number of the pump's volumetric displacement cavities. As illustrated in FIG. 2, a triplex positive displacement pump would repeat a pulsation pattern 16 every 120 degree rotation of the pump input shaft. These torque variations above 10 and below 12 the mean 14 are calculated and recorded for Block 1 of FIG. 1.

For other pumps such as a quintaplex plunger pump, which incorporates five plungers, a pulsation pattern would be produced five times per revolution of the pump input shaft, repeating every 72 degrees if the output pressure is to remain constant; and for a rotary vane pump with nine vanes selected, the pulsation pattern would repeat every 40 degree rotation of the pump input shaft if the output pressure is to remain constant.

Figure 3:
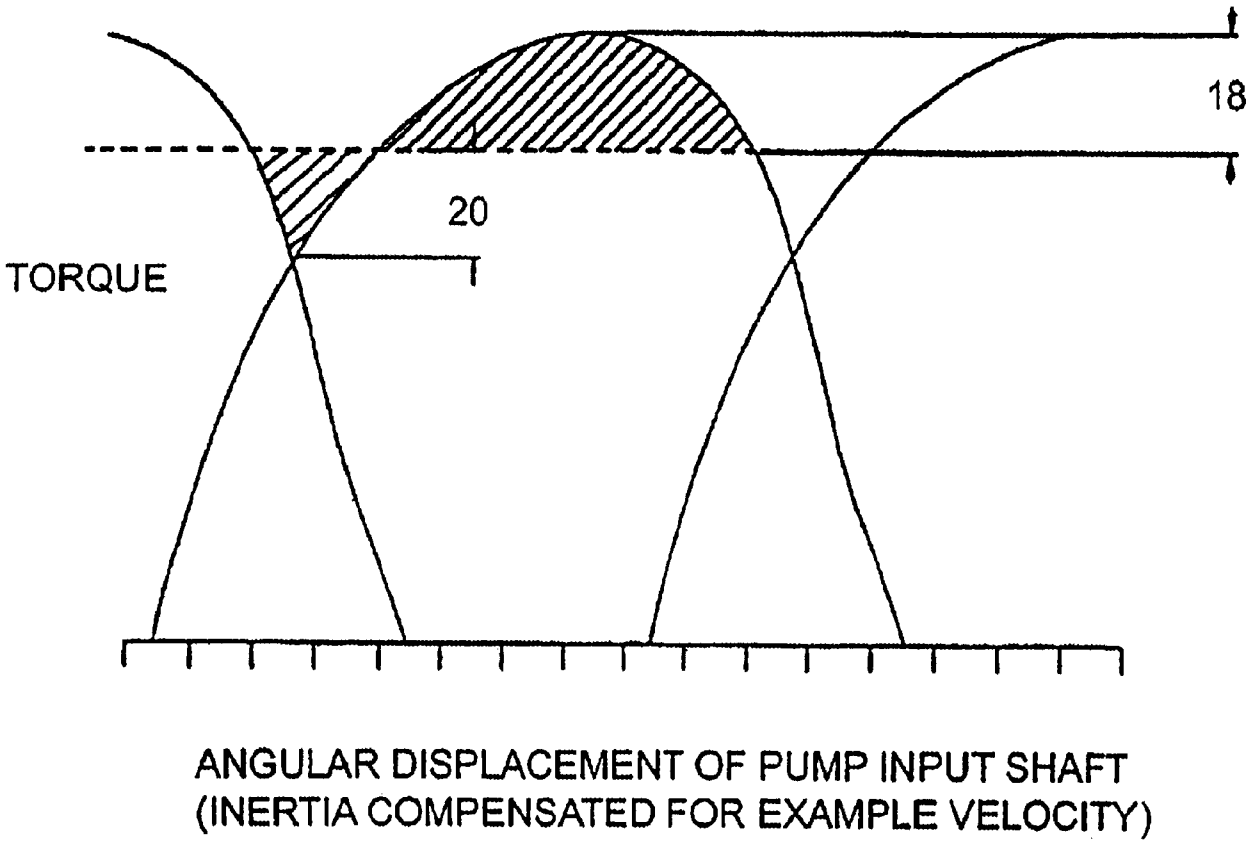
FIG. 3 is a graph depicting a percentile summation of input torque variation compared to angular displacement of the input shaft of a triplex pump.

In Block 2 of FIG. 1 and depicted graphically in FIG. 3, the torque profile versus displacement angle of the targeted pumping system is the summation of the torque requirement for each volumetric displacement component, depicting a percentage above mean 18 and the percentage below mean 20.

In Block 3 of FIG. 1, the magnitude of the input torque variation for the power pump is determined by the processor, where the magnitude of the torque variation is the number of volumetric displacement cavities activated in one revolution and the relationship "Q". The calculation "Q" is the linear distance "L" between the plunger/piston pivot point and the throw pivot point multiplied by the throw radius "R"; "Q=LR". FIG. 4 in table form, depicts the percentile variations of input torque above and below the mean for triplex pumps with various "Q".

Figure 5:
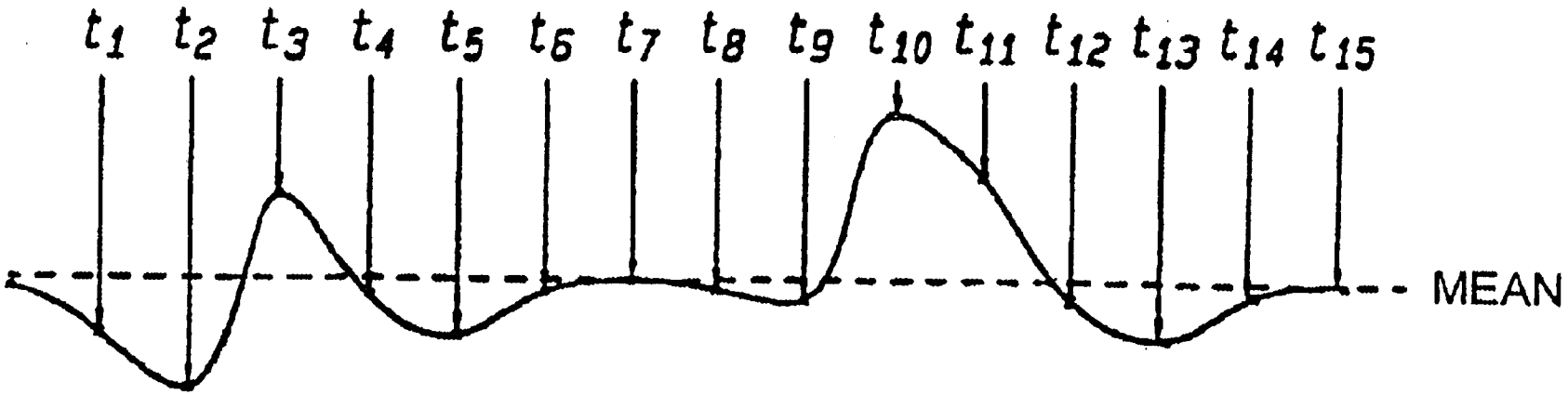
FIG. 5 is a graph depicting a plotting of geometric distance variation points based upon the total torque variation for a triplex pump.

FIG. 5 graphically depicts the total torque variation to show a torque profile for a triplex pump (three volumetric displacements per revolution) with a "Q" at 4:1 with variations shown above and below the mean. The mean is representative of the basic rms (root mean squared) torque requirement of the pump input shaft rated at a specific output pressure of the pump versus the angular displacement of the pump crank shaft. The relationship of "Q" and the effect it has on torque variation would also apply to rotary pumps. A plotted geometric distance variation using t1–t15 (as plotting points) is then imposed on the torque profile.

Figure 6:
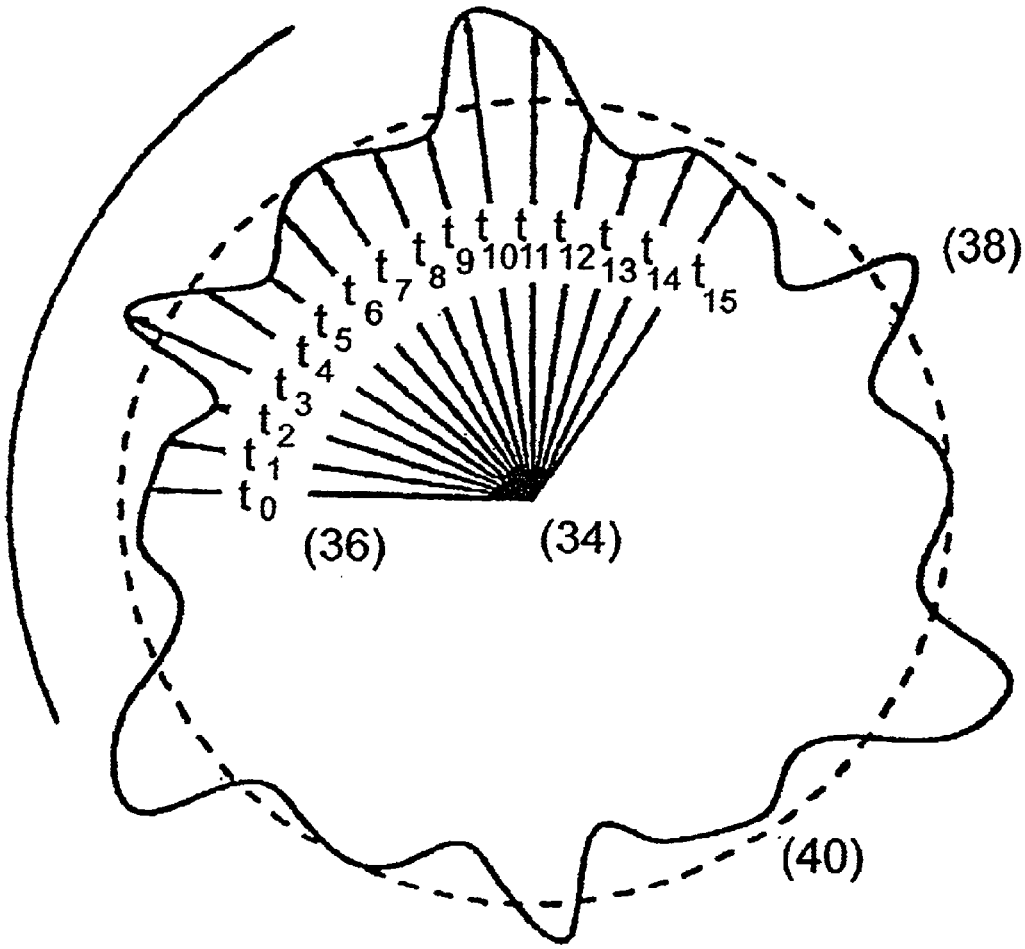
FIG. 6 is a polar map depicting the torque profile versus angular displacement of a pump input shaft.

In Block 4 of FIG. 1 and graphically depicted in FIG. 6, a pump polar map is determined based on the torque profile and the input shaft angular displacement of the pump. The center 34 of the polar map is to represent zero torque. The incremental lines 36 depicted orbitally are the angular displacement of the targeted pump's input shaft. The plotted pump torque variation curve 38 that occurs above and below the mean 40 is to be considered a geometric percentage of the summation of the torque requirement of each of the volumetric displacement components of the targeted pump.

The distance of each point plotted on the polar map's center from the base diameter's center is the geometric distance variation (over or under) of the base radii percentile established from torque versus the pump input shaft displacement angle (t1 thru t15). The geometric distance variations are the plotting points determined in FIG. 5. The torque versus angular displacement profile of the pump system selected is to become the reference polar guide for the comparitor algorithm in the processor in Block 5 of FIG. 1. The reference polar guide determined by the processor in Blocks 1–5 can also be determined externally from the processor and then input into the processor.

Blocks 6–10 of FIG. 1 are the operating steps from electronic attenuation of the torque profile to provide a constant output pressure at the pump, wherein Block 6 indicates the transmission of the angular displacement of the input shaft of a pump in operation. A pulse transmitter mounted on the input shaft relays to a counter—which is part of the processor—the angular position of the pump drive.

In Block 7 of FIG. 1, an electronic processor gathers this output shaft orientation feedback information, and processes the angular displacement data. The processor then attenuates from the peak requirement of the pump, the output torque of the drive compared to the predetermined reference polar map of Block 5. A corresponding torque command value is then selected.

In Block 8 of FIG. 1, other inputs of system readings such as system inertia, parasitic leads, off throttle friction, response time of the pump, motor inductive reactance, application characteristics of the pump, regenerative energy during deceleration of the pump, and translation speed can be selectively factored into the processor algorithm for changes in process control.

In Block 9 of FIG. 1, based upon the inputs of Blocks 7 and 8, the processor of the electronic drive signals the motor controller to apply the correct amperage, voltage, and frequency to the motor which then provides the correct torque according to the angular displacement of the pump input shaft.

In Block 10 of FIG. 1, the resultant signal to the motor controller and motor will drive the pumping system to produce constant pressure at the full range of the designed system flow volume regardless of pump radial crankshaft location and the velocity of the fluid pumped.

Block 11 of FIG. 1, depicts the use of this method in future systems where information gathered from pump operation by this method can be used to design more responsive components such as transmissions and electronic drives. More responsive components would decrease the time increments between Blocks 6–10. As response times are decreased, the torque output produced for indicated angular displacements will increase in efficiency.

Figure 7:
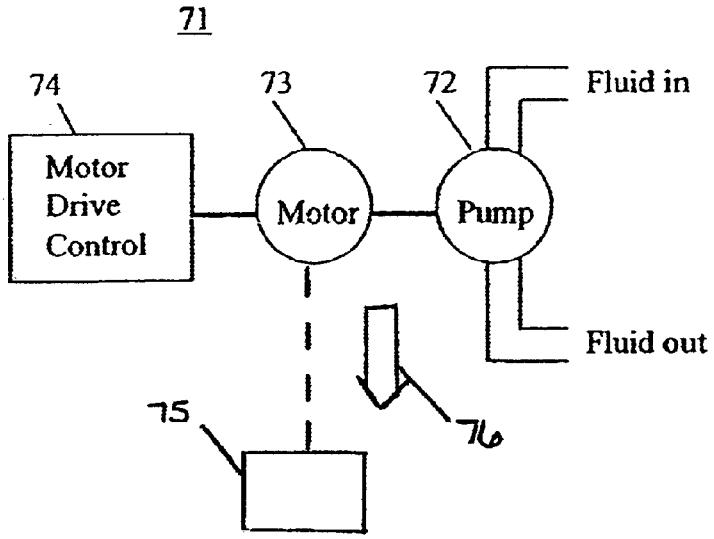
FIG. 7 is a diagram illustrating a precision hydraulic delivery system according to the present invention.

FIG. 7 depicts a precision hydraulic delivery system 71 according to the present invention. Advantageously, this system provides direct coupling of a positive displacement pump 72 to a prime mover 73 and related motor drive control 74. The prime mover 73 in the pump system shown is, for example, a constant speed induction motor. The motor has, for example, a 1000-1 (torque) turn down ratio. The motor control 74 may be, for example, an electronic servo type motor control. Direct coupling of the pump 72 to the motor 73 and motor control 74 allows for complete motion control of the pump 72 without requiring any of the downstream flow control devices, feedback devices, hydraulic energy storage devices (accumulators) or energy dissipation devices normally used in conventional pump systems.

The system in FIG. 7 employs motion control algorithms in the electronic motor control so that the hydraulic output at the pump head will simultaneously follow the control signals generated by the algorithms and sent to the motor. This ability allows a large dynamic range of hydraulic energy to be delivered by placing the "smarts" of the system directly into the electrical handling capabilities of the prime mover circuit. The modulation of torque (resulting in hydraulic pressure) and velocity (resulting in hydraulic flow) are most efficiently handled within the electronic servo type control of the primary mover.

The teachings of U.S. patent application Ser. No. 09/821,603 and U.S. Pat. No. 5,971,721, which are hereby incorporated by reference, may be incorporated into the macro motion control capabilities described herein to provide improved system response, "keypad" tuning of a hydraulic application, very high systemic efficiency characteristics and simplified hydraulic circuitry.

Several exemplary control features of the present invention are described in greater detail below. These features represent only a fraction of the possible features that may be electronically integrated into a hydraulic delivery system by control algorithms and subroutines for a prime mover servo control system coupled to a pump.

"SLAM Absorption" Feature

The "SLAM" subroutine is an energy absorbing function that provides hydraulic component protection by eliminating pressure spikes. In some applications, a "spike" in pressure occurs when flow volume is rapidly reduced. This normally occurs when, for example, a directional control valve is shut, and is typically followed by the pressure relief valve waste-gating the excess flow to a tank until the system flow returns to normal.

This condition is undesirable, and to eliminate it the present invention has a discrete input that activates the "SLAM" function when such an event occurs. A determination as to the likelihood of such an event is made during commissioning. Use of the "Position Sensing" feature (described below) allows the "SLAM" subroutine to be invoked when necessary. The "SLAM" feature causes the electronic drive to capture the inertial energy of the system via the regenerating capabilities of the prime mover (turning the motor into a generator), and to store this captured electrical energy 76 in the energy storage means 75 (see "energy storage system" below). The normally waste-gated energy is thus captured by the drive during this function, thereby saving energy and reducing wear on the hoses and hydraulic system.

"JAB Applied" Feature

The "JAB" feature eliminates pressure "droop" by invoking a rapid pump acceleration feature of user defined time and amplitude, that is applied over and above the normal flow or pressure input commands. In some instances, a rapid increase in flow volume required by the application will cause the pressure to droop until high inertia components in the pumping system are accelerated to the required delivery velocity. If this droop is undesirable in a specific application, a discrete input can be used to activate this "JAB" rapid acceleration feature that is applied over and above the normal flow or pressure input commands that are controlling the pump.

Dual Function Pump/Motor Feature

This feature provides for single unit hydraulic motor/pump functions from the same hydraulic device for energy delivery and reclamation (regeneration and storage).

"Pressure Loop" Feature

This feature provides a pump shaft torque output measurement method which is translated into a pressure delivered signal.

"Constant HP System" Feature

This feature provides a constant horse power electrical drive system for maintaining an energy ceiling regardless of the delivered flow volume.

"Energy Storage System" Feature

This feature provides an electrical energy storage device 75 in the drive system for reclamation of energy from regeneration (see "Dual function pump/motor" and "SLAM" function), or for high output energy spikes typically provided by a hydraulic accumulator.

"Position Sensing" Feature

According to this feature, a volumetric pulse correlates to a pump output volume that will cause an incremental pulse to occur. This volumetric pulse (output by the electronic drive module) is used for the positioning of known hydraulic cylinders and their corresponding volumetric displacements.

"Leakage Detection" Feature

This subroutine is used to detect user defined excessive hydraulic leakage rates. This feature compares the output of the "Position Sensing" function to a known limit during a move, and if there is a discrepancy beyond a predetermined amount, an alarm output results.

"Output Gain Offset" Feature

This feature allows the user to assess the output gain levels of the hydraulic delivery (pressure vs. flow) in order to overcome any application flow restrictions or mechanical variation. The assessment results in a profile of torque vs. velocity for the desired hydraulic output.

Figure 8:
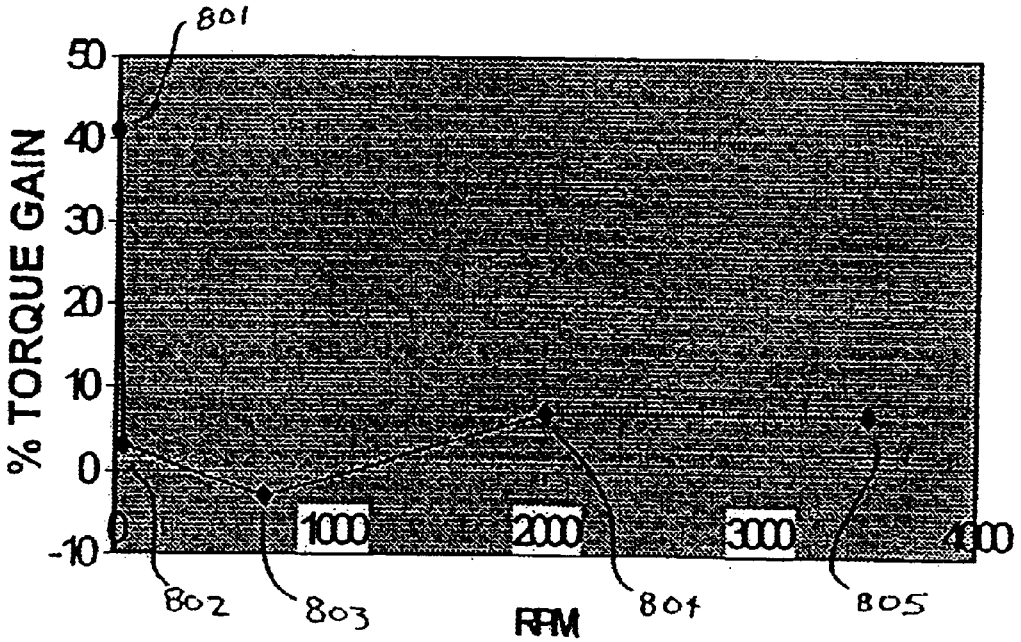
FIG. 8 is a graph depicting a profile of torque vs. velocity for an exemplary hydraulic system in accordance with the present invention.

FIG. 8 shows an example 5 point torque profile, including:(1) Gain Zero 801, (2) Gain Lo 802, (3) Gain Mid 803, (4) Gain Hi 804, and (5) Gain Max 805. The five gain points plotted on the graph are described below.

1. Gain Zero: For "pressure delivered" vs. "zero velocity" (the RPM of this point is always anchored at zero RPM), the Gain Zero corrects the pressure reference command as the velocity decreases to "0" to compensate for systemic "stiction".

2. Gain Low: For "pressure delivered" vs. "velocity," the Gain Low corrects the pressure reference command as the velocity increases/decreases to compensate for system losses.

Gain Low RPM: Applies the "GAIN LOW" value when the pump system is operating within a user defined RPM range (typically, 0 to 50 RPM). The gain is applied as a tapered offset beginning with the "GAIN ZERO" value at 0 RPM, and ending with the "GAIN LOW" value at the "GAIN LOW RPM." Any operation above this speed is ramped to the "GAIN MID" point.

3. Gain Mid: For "pressure delivered" vs. "velocity," the Gain Mid corrects the pressure reference command as the velocity increases/decreases to compensate for system losses.

Gain Mid RPM: Applies the "GAIN MID" value when the pump system is operating within a user defined RPM range (typically, 50 to 700 RPM). The gain is applied as a continued offset beginning with the "GAIN LO" value at the "GAIN LO RPM" and ending with the "GAIN MID" value at the "GAIN MID RPM." Any operation above this speed is ramped to the "GAIN HI" point.

4. Gain High: For "pressure delivered" vs. "velocity," the Gain High corrects the pressure reference command as the velocity increases/decreases to compensate for system losses.

Gain High RPM: Applies the "GAIN HIGH" value when the pump system is operating within a user defined RPM range (typically, 701 to the maximum RPM). The gain is applied as a continued offset beginning with the "GAIN MID" value at the "GAIN MID RPM" and ending with the "GAIN HIGH" value at the "GAIN HIGH RPM." Any operation above this speed is ramped to the GAIN MAX RPM point.

5. Gain Max: For pressure delivered vs. DRIVE SPEED MAX velocity (the RPM of this point is always anchored at the drive speed max RPM), the Gain Max attenuates the pressure reference command as the velocity increases/decreases to compensate for system losses.

Modifications to the above would be obvious to those of ordinary skill in the art, but would not bring the invention so modified beyond the scope of the appended claims.

What is claimed is:

1. A pump system comprising:

a pump for pumping a fluid;

a drive motor directly coupled to said pump; and a motor control coupled to said pump for controlling said drive motor; said motor control employing a motion control algorithm to control a hydraulic output at an input shaft of the pump, wherein the algorithm includes a subroutine for calculating a magnitude of a pump shaft torque output and translating the torque output into a pressure delivered signal.

2. The system of claim 1, wherein said drive motor is operable to both drive the pump and to generate energy using the hydraulic output.

3. The system of claim 1, further comprising means for storing electrical energy including reclaimed energy from regeneration.

4. The system of claim 1, wherein the algorithm further includes a subroutine for detecting a pump leakage rate and outputting an alarm when a predetermined leakage limit is exceeded.

5. A pump system comprising:

a pump for pumping a fluid;

a drive motor directly coupled to said pump; and a motor control coupled to said pump for controlling said drive motor; said motor control employing a motion control algorithm to control a hydraulic output of the pump, wherein any excess hydraulic output is used to generate electrical energy when a pressure spike occurs; the electrical energy being stored in an energy storage means, said generation and storage of electrical energy resulting in the elimination of the pressure spike.

6. A pump system comprising:

a pump for pumping a fluid;

a drive motor directly coupled to said pump; and a motor control coupled to said pump for controlling said drive motor; said motor control employing a motion control algorithm to control a hydraulic output of the pump, wherein the algorithm includes a subroutine for overriding existing hydraulic output settings when a pressure droop occurs so that the pressure droop is eliminated.

7. A pump system comprising:

a pump for pumping a fluid;

a drive motor directly coupled to said pump; and a motor control coupled to said pump for controlling said drive motor; said motor control employing a motion control algorithm to control a hydraulic output of the pump, wherein the algorithm includes a subroutine for maintaining a constant horsepower from the drive motor, thereby limiting hydraulic output to an application.

8. A pump system comprising:

a pump for pumping a fluid;

a drive motor directly coupled to said pump; and a motor control coupled to said pump for controlling said drive motor; said motor control employing a motion control algorithm to control a hydraulic output of the pump, wherein the algorithm includes a subroutine for assessing a pump output level and applying a profile of torque vs. velocity corresponding to the assessed output level.

9. A method for controlling a pump, comprising the steps of:

determining a reference polar guide of torque profile compared to an angular displacement of an input shaft of said pump;

measuring an angular position of a pump drive shaft in operation;

comparing said angular position with said reference polar guide; selecting a corresponding torque command value from the comparison of the angular position with the polar guide; and powering the pump to provide a constant output pressure.

* * * * *